US011165180B2

(12) United States Patent
Kim et al.

(10) Patent No.: US 11,165,180 B2
(45) Date of Patent: Nov. 2, 2021

(54) CONNECTION TERMINAL AND TERMINAL CONNECTION BODY

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP)

(72) Inventors: Jisung Kim, Yokkaichi (JP); Mitsuru Hirose, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/976,785

(22) PCT Filed: Feb. 27, 2019

(86) PCT No.: PCT/JP2019/007526
§ 371 (c)(1),
(2) Date: Aug. 31, 2020

(87) PCT Pub. No.: WO2019/176539
PCT Pub. Date: Sep. 19, 2019

(65) Prior Publication Data

US 2021/0044048 A1 Feb. 11, 2021

(30) Foreign Application Priority Data

Mar. 15, 2018 (JP) ..... JP2018-048261

(51) Int. Cl.
*H01R 13/02* (2006.01)
*H01R 13/18* (2006.01)
*H01R 4/48* (2006.01)

(52) U.S. Cl.
CPC ..... *H01R 13/18* (2013.01); *H01R 4/48* (2013.01)

(58) Field of Classification Search
CPC ..... H01R 13/18; H01R 13/17; H01R 13/10; H01R 13/05; H01R 13/04; H01R 13/025;
(Continued)

(56) References Cited

U.S. PATENT DOCUMENTS 2,233,718 A * 3/1941 Soreng ..... H01R 13/20 439/839
2,292,352 A * 8/1942 Cook ..... C07F 7/24 44/369

(Continued)

FOREIGN PATENT DOCUMENTS

EP 0352967 A1 1/1990
EP 2031707 A2 3/2009

(Continued)

OTHER PUBLICATIONS

May 28, 2019 International Search Report issued in International Patent Application No. PCT/JP2019/007526.

*Primary Examiner* — Harshad C Patel
(74) *Attorney, Agent, or Firm* — Oliff PLC

(57) ABSTRACT

A connection terminal for connecting a first conductor and a second conductor, the connection terminal including: a connection configured to be connected to the first conductor; an arc-shaped fitting that extends from the connection, and is configured to be fitted to, while being in surface contact with, a tubular outer circumferential surface of the second conductor over a half of the circumference thereof, with application of restoring force after elastic deformation; and (Continued)

a pair of extensions that extend from two ends, in a circumferential direction, of the arc-shaped fitting, and are curved to a side opposite to a side to which the arc-shaped fitting is curved.

5 Claims, 6 Drawing Sheets

(58) Field of Classification Search
CPC . H01R 13/02; H01R 4/48; H01R 4/38; H01R 4/28; H01R 4/26
USPC ..... 439/839
See application file for complete search history.

(56) References Cited

U.S. PATENT DOCUMENTS 3,317,887 A * 5/1967 Henschen ..... H01R 13/187 439/843
3,716,821 A * 2/1973 Appleton ..... H01R 13/18 439/787
3,914,008 A * 10/1975 Hollander ..... H01R 13/18 439/687
4,009,924 A * 3/1977 Bungo ..... H01T 13/04 439/839
4,472,018 A * 9/1984 Urani ..... H01H 85/205 439/814
4,553,799 A * 11/1985 Deters ..... H01R 31/085 439/507
4,921,456 A 5/1990 French
4,938,720 A * 7/1990 Romak ..... H01R 13/18 439/839
5,007,865 A * 4/1991 Jakobeit ..... H01R 13/18 439/839
5,616,036 A * 4/1997 Polidori ..... H01R 4/60 248/74.1
6,692,316 B2 * 2/2004 Hsieh ..... H01R 13/187 439/224
7,766,706 B2 * 8/2010 Kawamura ..... H01R 13/18 439/839
9,142,902 B2 * 9/2015 Glick ..... H01R 43/16
10,033,120 B2 * 7/2018 Herron ..... F16L 1/11
2005/0032440 A1 2/2005 Kurimoto

FOREIGN PATENT DOCUMENTS

JP S55-48694 U 3/1980
JP H05-166560 A 7/1993
JP 2005-56792 A 3/2005
JP 2012-074160 A 4/2012

* cited by examiner

CONNECTION TERMINAL AND TERMINAL CONNECTION BODY

BACKGROUND

The present disclosure relates to a connection terminal for connecting a first conductor and a second conductor, and a terminal connection body in which the first conductor and the second conductor are connected to each other by the connection terminal.

When, for example, any of various types of control equipment for performing electronic control is connected to a control device, a wire drawn from the control equipment may be connected to a wire drawn from the control device using a connection terminal, taking into consideration the assemblability or the like. When the wires are connected to each other using a connection terminal, bolt fastening may be performed, a crimp terminal may be used, or a round pin terminal may be used, for example. Also, a connection terminal serving as a connector or the like uses the spring characteristics to keep the conduction.

If bolt fastening is performed on a connection terminal, a bolt will be tightened to fasten terminal portions provided at ends of the wires to each other. Also, if a crimp terminal is used as a connection terminal, terminal portions provided at the ends of the wires will be crimped and fastened to each other. Also, if a round pin terminal is used as a connection terminal, a male pin provided at an end of one wire will be pressed into a female pin provided at an end of the other wire so that these pins are fastened to each other.

Furthermore, one example of the connection terminal that serves as a connector or the like and uses the spring characteristics is a connection terminal disclosed in JP 1105-166560A. The connection terminal of JP 1105-166560A is provided with a wire crimping portion on one end side, and a contact spring portion on a leading end surface on the other end side, the contact spring portion being brought into elastic contact with a counterpart member.

SUMMARY

If the connection terminal for bolt fastening is used, the bolt can be tightened to bring the terminal portions into rigid surface contact with each other. Accordingly, it is possible to reduce the electrical resistance of the connection terminal as much as possible. However, the entire dimension of the connection terminal including the bolt will be large, and a space for arrangement of a tool for tightening the bolt will also need to be ensured.

If the crimp terminal is used as a connection terminal, the terminal portions will be partially crimped, and the contact area between the terminal portions will be reduced. Therefore, the electrical resistance of the connection terminal will increase. Also, if the round pin terminal is used as a connection terminal, the male pin and the female pin will be partially brought into line contact with each other at multiple positions, and the electrical resistance of the connection terminal will increase. Furthermore, if the connection terminal disclosed in JP H05-166560A that uses spring characteristics is used, the area in which the contact spring portion is in elastic contact with a counterpart member will be small, and the electrical resistance of the connection terminal will increase. Accordingly, in any of the cases, there is the risk that the connection terminal may generate heat, and the temperature thereof may increase.

An exemplary aspect of the disclosure provides a connection terminal and a terminal connection body with which the electrical resistance between the connection terminal and a conductor can be kept low, disengagement from the conductor can be made difficult, and downsizing is possible.

According to one aspect of the present disclosure, a connection terminal for connecting a first conductor and a second conductor includes: a connection configured to be connected to the first conductor; an arc-shaped fitting that extends from the connection, and is configured to be fitted to, while being in surface contact with, a tubular outer circumferential surface of the second conductor over a half of the circumference thereof, with application of restoring force after elastic deformation; a pair of extensions that extend from two ends, in a circumferential direction, of the arc-shaped fitting, and are curved to a side opposite to a side to which the arc-shaped fitting is curved; and a reinforcement spring that has the shape of a plate curved in an arc shape along an outer circumferential surface of the arc-shaped fitting, is fitted to, while being in surface contact with, the outer circumferential surface of the arc-shaped fitting over a half of the circumference thereof, and applies restoring force after elastic deformation to the outer circumferential surface of the arc-shaped fitting.

According to another aspect of the present disclosure, a terminal connection body includes: a first conductor having a connection terminal; and a second conductor connected to the connection terminal, wherein the connection terminal includes: a connection n connected to the first conductor; an arc-shaped fitting that extends from the connection, and is fitted to, while being in surface contact with, a tubular outer circumferential surface of the second conductor over a half of the circumference thereof, with application of restoring force after elastic deformation; a pair of extension that extend from two ends, in a circumferential direction, of the arc-shaped fitting, and are curved to a side opposite to a side to which the arc-shaped fitting n is curved; and a reinforcement spring that has the shape of a plate curved in an arc shape along an outer circumferential surface of the arc-shaped fitting n, is fitted to, while being in surface contact with, the outer circumferential surface of the arc-shaped fitting over a half of the circumference thereof, and applies restoring force after elastic deformation to the outer circumferential surface of the arc-shaped fitting, and the second conductor includes, at a leading end of the second conductor, an increased diameter portion that prevents the arc-shaped fitting from being removed from the tubular outer circumferential surface in an axial direction.

The connection terminal of the one aspect includes the connection, the arc-shaped fitting, the pair of extensions, and the reinforcement spring. Also, the arc-shaped fitting is fitted to the tubular outer circumferential surface of the second conductor over a half of the circumference thereof, with application of restoring force after elastic deformation. Also, the arc-shaped fitting can be brought into surface contact with the tubular outer circumferential surface of the second conductor. With the connection terminal, it is possible to keep the electrical resistance between the connection terminal and the second conductor low, and suppress the amount of heat generation of the connection terminal.

Also, as a result of the reinforcement spring being fitted to the outer circumference of the arc-shaped fitting, it is possible to increase the spring strength of the arc-shaped fitting, and increase the restoring force that acts on the second conductor from the arc-shaped fitting. This can make the arc-shaped fitting unlikely to disengage from the second conductor.

Also, the arc-shaped fitting can be brought into areal contact with the tubular outer circumferential surface of the second conductor, and the pair of extensions can be formed slightly protruding from the arc-shaped fitting. Accordingly, it is possible to downsize the connection terminal.

Also, when the arc-shaped fitting is elastically deformed so that its diameter is increased at the time of the arc-shaped fitting being fitted to the tubular outer circumferential surface of the second conductor, the pair of extensions can be used to guide the second conductor to the arc-shaped fitting. Also, the pair of extensions may also be used as a latching portion for latching a retaining member that retains the arc-shaped fitting and prevents the arc-shaped fitting from disengaging from the tubular outer circumferential surface of the second conductor.

Therefore, according to the connection terminal of the one aspect, it is possible to keep the electrical resistance between the connection terminal and a conductor low, and downsize the connection terminal.

The terminal connection body of the other aspect is such that a first conductor and a second conductor are connected to each other by a connection terminal, and, as the connection terminal, the connection terminal according to the one aspect that includes the connection, the arc-shaped fitting, and the pair of extensions is employed. Also, with the terminal connection body, the increased diameter portion formed at the leading end of the second conductor can prevent the arc-shaped fitting from being removed from the tubular outer circumferential surface of the second conductor in the axial direction.

Therefore, according to the terminal connection body of the other aspect, it is possible to keep the electrical resistance between the connection terminal and the conductor low, downsize the connection terminal, and prevent the connection terminal from being removed from the conductor in the axial direction.

DETAILED DESCRIPTION OF EMBODIMENTS

Preferred embodiments of the above-described connection terminal and terminal connection body will be described with reference to the drawings.

Embodiment 1

Figure 1:
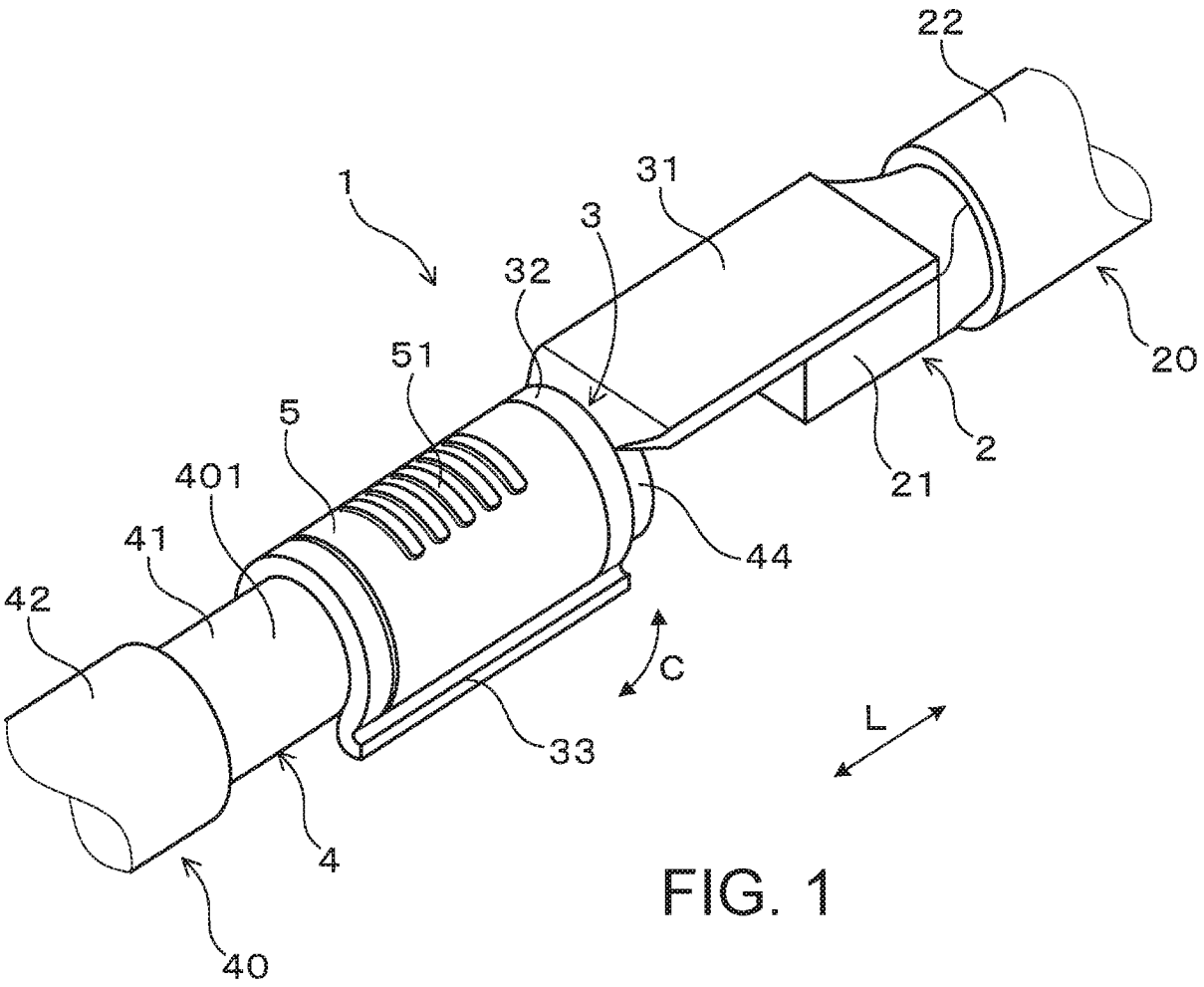
FIG. 1 is a perspective view illustrating a connection terminal and a terminal connection body according to Embodiment 1.
Figure 2:
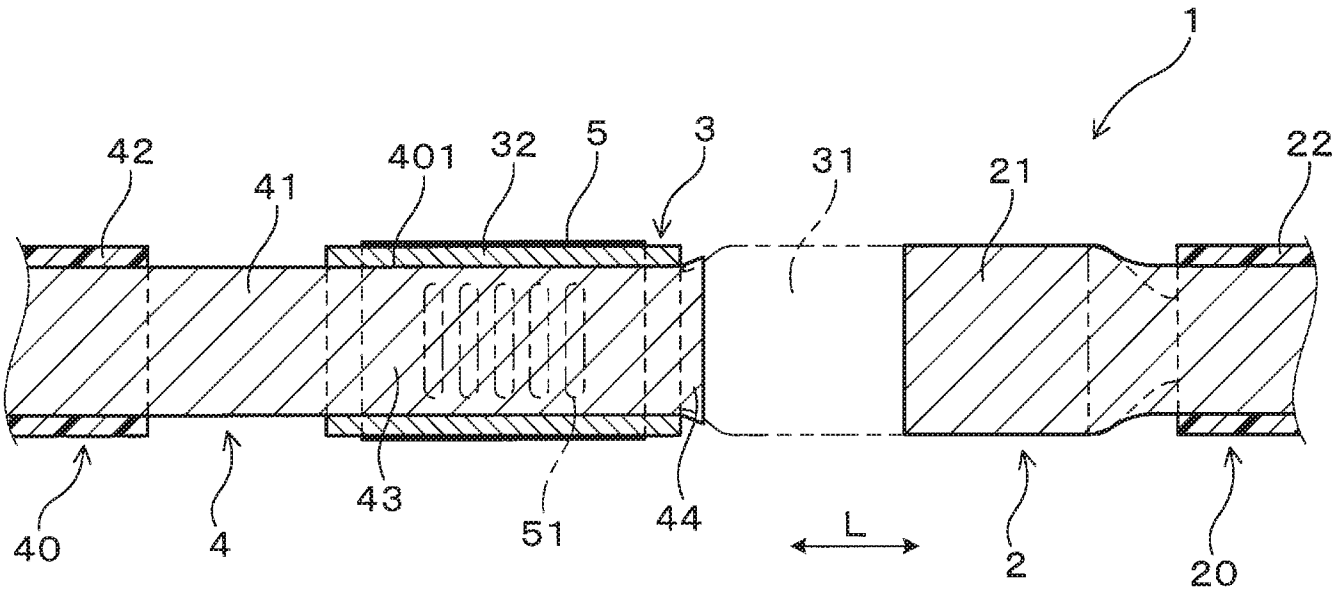
FIG. 2 is a cross-sectional view illustrating the connection terminal and the terminal connection body according to Embodiment 1, taken along an axial direction of a first conductor and a second conductor.
Figure 3:
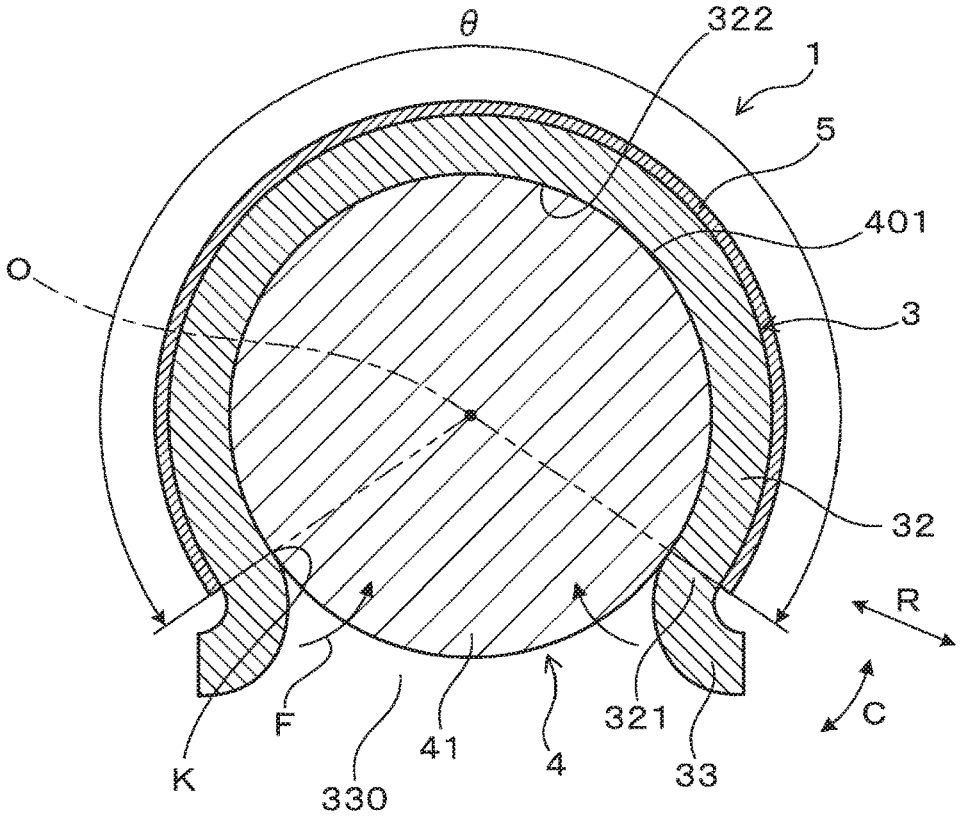
FIG. 3 is a cross-sectional view illustrating the connection terminal and the terminal connection body according to Embodiment 1, taken along a direction orthogonal to the axial direction of the first conductor and the second conductor.

As shown in FIGS. 1 to 3, a connection terminal 3 of the present embodiment is used to connect a first conductor 2 and a second conductor 4. The connection terminal 3 includes a connection portion 31 (connection), an arc-shaped fitting portion 32 (arc-shaped fitting), a pair of extending portions 33 (extensions), and a reinforcement spring 5. The connection portion 31 is a portion that is connected to the first conductor 2. The arc-shaped fitting portion 32 is a portion that extends from the connection portion 31, and is fitted to a tubular outer circumferential surface 401 of the second conductor 4 over a half of the circumference thereof, while applying restoring force F after elastic deformation. The pair of extending portions 33 extend from two ends 321, in a circumferential direction C, of the arc-shaped fitting portion 32, and are curved to a side opposite to the side to which the arc-shaped fitting portion 32 is curved. The reinforcement spring 5 is fitted to the outer circumference of the arc-shaped fitting portion 32, and applies the restoring force F after elastic deformation to an outer circumferential surface 323 of the arc-shaped fitting portion 32.

The terminal connection body 1 of the present embodiment includes the first conductor 2 having the connection terminal 3 and the second conductor 4 connected to the connection terminal 3. The second conductor 4 includes, at the leading end thereof, an increased diameter portion 44 that prevents the arc-shaped fitting portion 32 from being removed from the tubular outer circumferential surface 401 in an axial direction L.

The following will describe in detail the connection terminal 3 and the terminal connection body 1 of the present embodiment.

As shown in FIGS. 1 and 2, the connection terminal 3 of the present embodiment is used, when control equipment that performs electronic control is connected to a control device, to connect the first conductor 2 of a first wire 20 drawn from the control equipment, and the second conductor 4 of a second wire 40 drawn from the control device. Note that a configuration is also possible in which the first wire 20 with the first conductor 2 is drawn from the control device, and the second wire 40 with the second conductor 4 is drawn from the control equipment.

The control equipment may be a motor serving as an actuator, a cylinder, a solenoid, or any of various sensors, for example. Also, the control equipment can be installed in a vehicle, and in this case, the control device may be an electronic control unit (ECU) of the vehicle.

First Conductor 2 and Connection Portion 31

As shown in FIGS. 1 and 2, the first conductor 2 of the present embodiment is formed as a conductor portion of the first wire 20. The first wire 20 is a so-called a covered wire, and includes the conductor portion, and a covering portion 22 that covers the conductor portion. The first wire 20 is a twisted wire in which a plurality of bar wires are bundled together and twisted. The first wire 20 includes an exposed conductor portion 21, which serves as a conductor portion and is exposed by stripping off the covering portion 22 at an end of the first wire 20. The exposed conductor portion 21 of the present embodiment is molded in a flat plate shape by performing pressing using a mold, for example.

The first wire 20 may also be a single wire, instead of a twisted wire. In this case, the first conductor 2 is formed by a solid conductor portion exposed at an end of the first wire 20. Also, the first conductor 2 may also be a solid conductor such as a busbar, instead of the conductor portion of the wire. This solid conductor may also be covered with, for example, an enamel resin.

Connection Portion 31 of Connection Terminal 3

As shown in FIG. 1, the connection portion 31 of the connection terminal 3 of the present embodiment is plate-shaped. Also, the connection portion 31 faces the exposed conductor portion 21 of the first wire 20, and is joined to the exposed conductor portion 21 using welding, soldering, or the like. Note that the connection portion 31 can have any shape as long as it allows connection of the first conductor 2 and the arc-shaped fitting portion 32. Also, the exposed conductor portion 21 may also have various shapes that conforms to the shape of the connection portion 31. Also, the connection portion 31 and the exposed conductor portion 21 may also be joined to each other using crimping, clamping, or the like.

Second Conductor 4

As shown in FIGS. 1 and 2, the second conductor 4 of the present embodiment is formed as a conductor portion of the second wire 40. The second wire 40 is a so-called covered wire, and includes the conductor portion, and a covering portion 42 that covers the conductor portion. The second wire 40 is a twisted wire in which a plurality of bar wires are bundled together and twisted. The second wire 40 includes an exposed conductor portion 41 that serves as a conductor portion exposed by stripping off the covering portion 42 at an end of the second wire 40.

Figure 4:
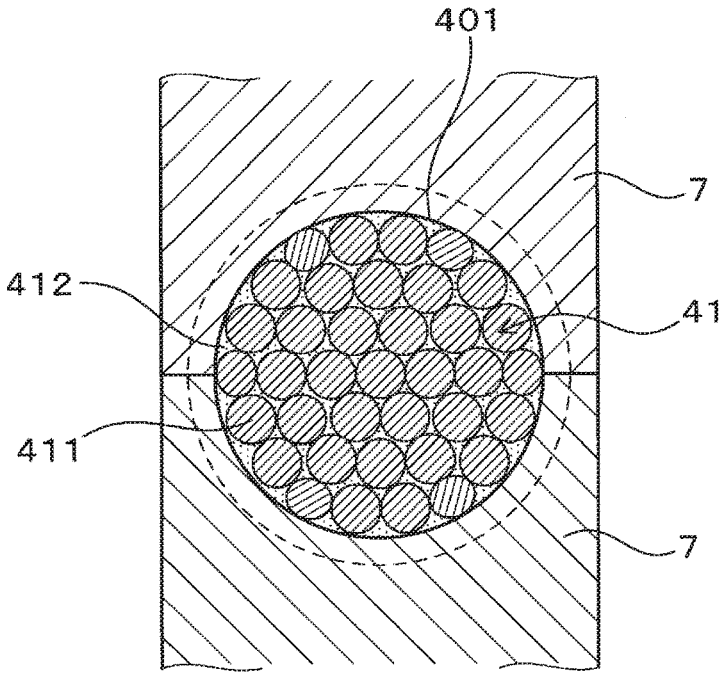
FIG. 4 illustrates a state in which an exposed conductor portion of the second conductor according to Embodiment 1 is molded.

As shown in FIG. 4, the exposed conductor portion 41 is molded in a tubular (columnar) shape by performing pressing using a mold 7, for example. Also, the tubular outer circumferential surface 401 of the second conductor 4 is formed as an outer circumferential surface molded in a columnar shape. Here, "tubular" has the same meaning as "columnar", and means the shape of a shaft having a circular cross section. The exposed conductor portion 41 can be molded by thermoforming. "Thermoforming" refers to treatment in which a plurality of bar wires 411 constituting the conductor portion are heated, and is molded into the conductor portion in a state in which they are softened. Also, the exposed conductor portion 41 can be molded into a tubular shape by adding another conductor material 412 to the conductor portion.

Increased Diameter Portion 44 of Second Conductor 4

Furthermore, as shown in FIG. 2, when the exposed conductor portion 41 serving as the second conductor 4 is molded, the diameter of the leading end of the exposed conductor portion 41 is increased relative to a portion on the base end side thereof. Thus, the increased diameter portion 44 is formed at the leading end of the exposed conductor portion 41 serving as the second conductor 4. The increased diameter portion 44 has an outer diameter larger than a remaining portion 43 of the exposed conductor portion 41, and is formed as a portion that is step-shaped or tapered from the remaining portion 43 so that the diameter is increased. The increased diameter portion 44 has a thickness in a radial direction R so that the arc-shaped fitting portion 32 is latched thereon.

Arc-Shaped Fitting Portion 32 of Connection Terminal 3

As shown in FIG. 3, the arc-shaped fitting portion 32 is formed in a range of an angle θ that is greater than 180° and is equal to or smaller than 300° in a circumferential direction C around a central axis O of the second conductor 4. Here, the angle θ at which the arc-shaped fitting portion 32 is formed is defined as an angle θ in the circumferential direction C at which an inner circumferential surface 322 of the arc-shaped fitting portion 32 is in contact with the tubular outer circumferential surface 401 of the second conductor 4. In FIG. 3, borders between the inner circumferential surface 322 of the arc-shaped fitting portion 32 and the pair of extending portions 33 are denoted by a reference sign K.

The arc-shaped fitting portion 32 is preferably formed at an angle θ that is equal to or greater than 210° in order that the arc-shaped fitting portion 32 is not likely to disengage from the tubular outer circumferential surface 401 of the second conductor 4 in the radial direction R. Also, the arc-shaped fitting portion 32 is preferably formed at an angle θ that is equal to or smaller than 270°, taking into consideration the second conductor 4 being inserted into an opening portion 330 between the pair of extending portions 33 in the radial direction R.

At the time of manufacturing the connection terminal 3, the arc-shaped fitting portion 32 before being fitted to the second conductor 4 is formed so as to be smaller than the outer diameter of the tubular outer circumferential surface 401 of the second conductor 4, so that the arc-shaped fitting portion 32 applies a spring force, serving as the restoring force F, to the second conductor 4 upon being fitted to the second conductor 4. Then, when the arc-shaped fitting portion 32 is elastically deformed, and is fitted to the tubular outer circumferential surface 401 of the second conductor 4, the restoring force F generated after the arc-shaped fitting portion 32 has been elastically deformed can act on the tubular outer circumferential surface 401 from the arc-shaped fitting portion 32.

The connection terminal 3 that includes the connection portion 31, the arc-shaped fitting portion 32, and the pair of extending portions 33 is made of a copper material such as copper or a copper alloy, in view of its high conductivity.

Pair of Extending Portions 33

As shown in FIG. 3, the pair of extending portions 33 are curved in an arc shape from the ends 321, in the circumferential direction C, of the arc-shaped fitting portion 32. The direction in which the pair of extending portions 33 are curved is opposite to the direction in which the arc-shaped fitting portion 32 is curved in an arc shape. The surfaces of the pair of extending portions 33 that face each other have a curved surface shape so as to realize smooth fitting to the second conductor 4.

Reinforcement Spring 5

As shown in FIGS. 1 to 3, the reinforcement spring 5 is made of a metal material whose specific resistance and spring constant are larger than those of the metal material of which the arc-shaped fitting portion 32 is made. Also, restoring force F of the reinforcement spring 5, together with the restoring force F of the arc-shaped fitting portion 32, acts on the tubular outer circumferential surface 401 of the second conductor 4.

The connection terminal 3 including the connection portion 31, the arc-shaped fitting portion 32, and the pair of extending portions 33 is made of a copper material such as copper or a copper alloy in view of its high conductivity. The copper material has excellent conductivity but does not have a markedly large Young's modulus (longitudinal elastic modulus), and thus it is difficult to increase the spring constant. Accordingly, in the present embodiment, a metal material that allows a larger spring constant compared to a copper material is used to increase the spring constant, which is regarded as weakness of a copper material.

The reinforcement spring 5 compensates the spring constant of the arc-shaped fitting portion 32 made of a copper material, and thus it is not necessary to take into consideration the conductivity thereof. The metal material of the reinforcement spring 5 may be a spring steel material (SUP material), a high-carbon steel material, an alloy steel material, a stainless steel material, or the like. Note that the surface of the connection terminal 3 may be provided with a plating film, taking into consideration the durability thereof.

The thickness of the reinforcement spring 5 is smaller than the thickness of the arc-shaped fitting portion 32. This configuration suppresses an increase in the outer diameter of the connection terminal 3 as much as possible, even if the reinforcement spring 5 is provided.

As shown in FIGS. 1 and 2, a plurality of projections (embossed portions) 51 are formed in the vicinity of the central portion, in the circumferential direction C, of the reinforcement spring 5, the plurality of projections extending in the circumferential direction C. The plurality of projections 51 are provided to enhance the strength of the reinforcement spring 5.

Fitting of Connection Terminal 3

First, the reinforcement spring 5 is fitted to the outer circumference of the arc-shaped fitting portion 32. Then, when the arc-shaped fitting portion 32 is fitted to the tubular outer circumferential surface 401 of the second conductor 4, the tubular outer circumferential surface 401 of the second conductor 4 is brought into contact with the pair of extending portions 33. Then, the second conductor 4 is pressed inside the arc-shaped fitting portion 32. At this time, the distance between the pair of extending portions 33 is enlarged by the tubular outer circumferential surface 401 of the second conductor 4, and the arc-shaped fitting portion 32 and the reinforcement spring 5 are elastically deformed so as to increase the curvature radius thereof.

When the second conductor 4 has been inserted into the arc-shaped fitting portion 32, the elastic deformation of the arc-shaped fitting portion 32 and the reinforcement spring 5 is partially recovered, so that the distance between the pair of extending portions 33 decreases, and the arc-shaped fitting portion 32 is brought into contact (areal contact) with the tubular outer circumferential surface 401 of the second conductor 4. At this time, the elastic deformation of the arc-shaped fitting portion 32 and the reinforcement spring 5 is not completely recovered, and the restoring force F after the elastic deformation of the arc-shaped fitting portion 32 and the reinforcement spring 5 act on the tubular outer circumferential surface 401 of the second conductor 4. Accordingly, it is possible to prevent the arc-shaped fitting portion 32 from disengaging from the second conductor 4 in the radial direction R.

Functions and Effects

The connection terminal 3 of the present embodiment includes the connection portion 31, the arc-shaped fitting portion 32, the pair of extending portions 33, and the reinforcement spring 5. Also, the arc-shaped fitting portion 32 is fitted to the tubular outer circumferential surface 401 of the second conductor 4 over a half of the circumference thereof, while applying the restoring force F after the elastic deformation. Then, the arc-shaped fitting portion 32 can be brought into surface contact with the tubular outer circumferential surface 401 of the second conductor 4. According to the connection terminal 3, it is thus possible to keep the electrical resistance between the connection terminal 3 and the second conductor 4 low, and suppress an amount of heat generation of the connection terminal 3.

Also, as a result of the reinforcement spring 5 being fitted to the outer circumference of the arc-shaped fitting portion 32, it is possible to increase the spring strength of the arc-shaped fitting portion 32, and increase the restoring force F that acts on the second conductor 4 from the arc-shaped fitting portion 32. This can make the arc-shaped fitting portion 32 unlikely to disengage from the second conductor 4.

Also, using the reinforcement spring 5, it is possible to easily design the conductivity and the spring strength of the arc-shaped fitting portion 32. In other words, the use of the reinforcement spring 5 eliminates the need to increase the thickness of the arc-shaped fitting portion 32 in order to enhance the spring strength. Therefore, the thickness of the arc-shaped fitting portion 32 needs only to be designed so that its electrical resistance is equal to or less than the electrical resistance required to ensure the conductivity, and thus the amount of a copper material used to form the arc-shaped fitting portion 32 can be reduced.

Also, the arc-shaped fitting portion 32 can be brought into areal contact with the tubular outer circumferential surface 401 of the second conductor 4, and the pair of extending portions 33 can be formed slightly protruding from the arc-shaped fitting portion 32. Accordingly, it is possible to downsize the connection terminal 3.

Also, when the arc-shaped fitting portion 32 is elastically deformed so that its dimeter is increased at the time of the arc-shaped fitting portion 32 being fitted to the tubular outer circumferential surface 401 of the second conductor 4, the pair of extending portions 33 can be used to guide the second conductor 4 to the arc-shaped fitting portion 32. Also, the pair of extending portions 33 may also be used as a latching portion for latching a retaining member 6 or the like that retains the arc-shaped fitting portion 32 and prevents the arc-shaped fitting portion 32 from disengaging from the tubular outer circumferential surface 401 of the second conductor 4, the retaining member 6 being described later in Embodiment 2.

Therefore, according to the connection terminal 3 of the present embodiment, it is possible to keep the electrical resistance between the connection terminal 3 and the second conductor 4 low, make the connection terminal 3 unlikely to disengage from the second conductor 4, and downsize the connection terminal 3.

Furthermore, the terminal connection body 1 of the present embodiment is such that the first conductor 2 and the second conductor 4 are connected to each other by the connection terminal 3, and, as the connection terminal 3, the connection terminal that includes the connection portion 31, the arc-shaped fitting portion 32, and the pair of extending portions 33 is employed. Also, according to the terminal connection body 1, the increased diameter portion 44 formed at the leading end of the second conductor 4 can prevent the arc-shaped fitting portion 32 from being removed from the tubular outer circumferential surface 401 of the second conductor 4 in the axial direction L.

Therefore, according to the terminal connection body 1 of the present embodiment, it is possible to keep the electrical resistance between the connection terminal 3 and the second conductor 4 low, downsize the connection terminal 3, and prevent the connection terminal 3 from being removed from the second conductor 4 in the axial direction L.

Embodiment 2

The connection terminal 3 and the terminal connection body 1 according to the present embodiment are improved relative to those described in Embodiment 1. In the connection terminal 3 of the present embodiment, ingenuity is exercised to prevent more reliably the arc-shaped fitting portion 32 from disengaging from the second conductor 4.

Figure 5:
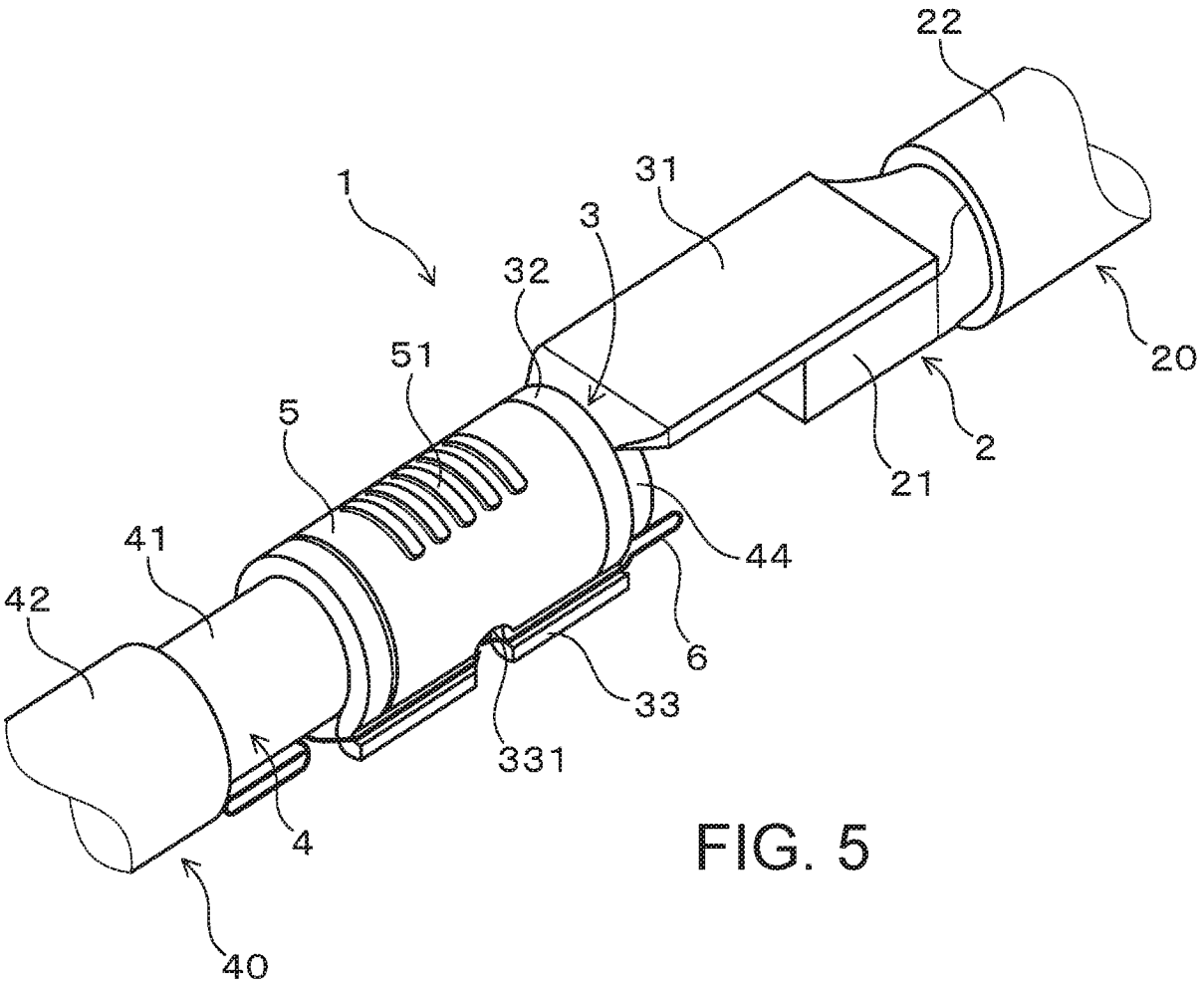
FIG. 5 is a perspective view illustrating a connection terminal and a terminal connection body according to Embodiment 2.
Figure 6:
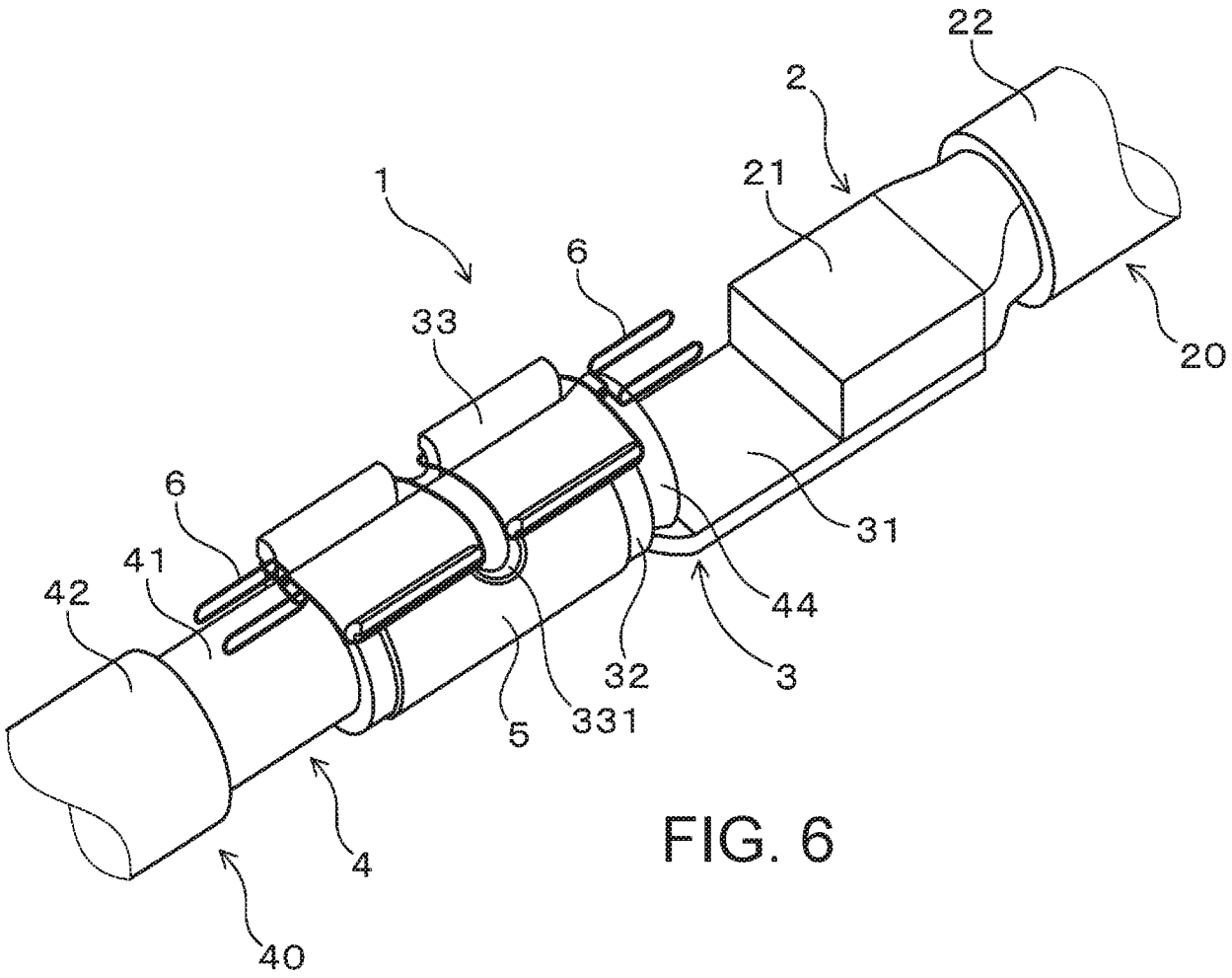
FIG. 6 is a perspective view illustrating the connection terminal and the terminal connection body according to Embodiment 2, on a side opposite to the side shown in FIG. 5.
Figure 7:
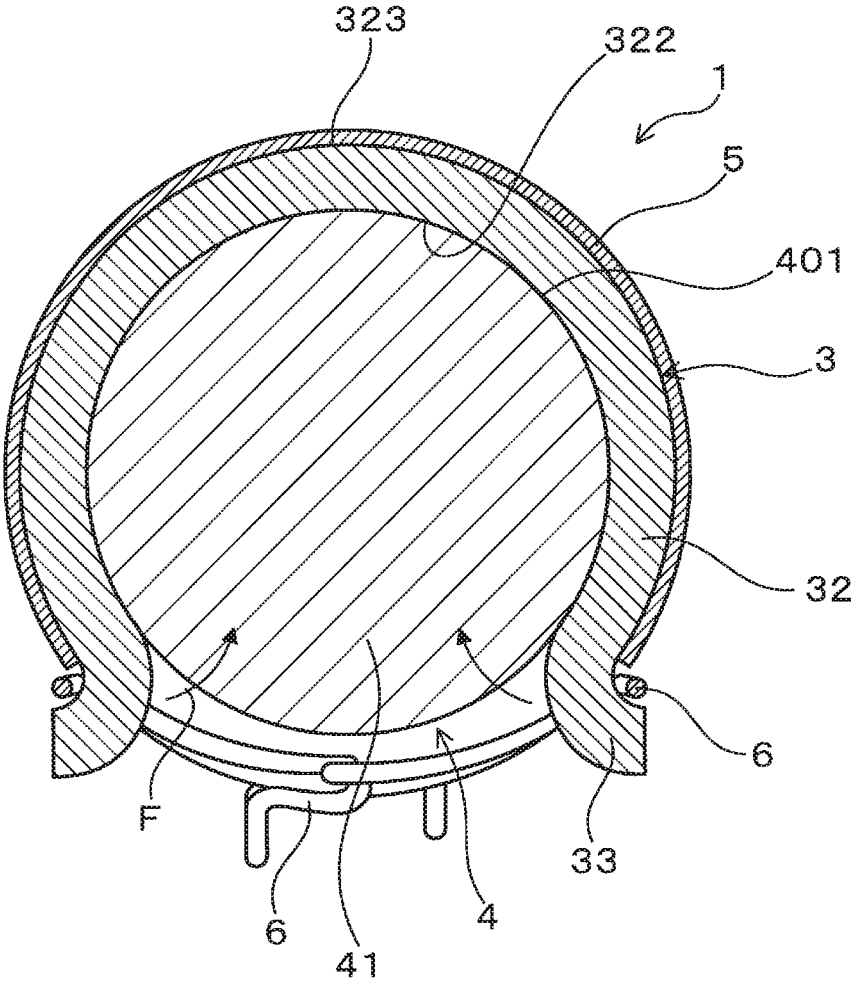
FIG. 7 is a cross-sectional view illustrating the connection terminal and the terminal connection body according to Embodiment 2, taken along a direction orthogonal to an axial direction of a first conductor and a second conductor.

As shown in FIGS. 5 to 7, a retaining member 6 is arranged between a pair of extending portions 33, and the retaining member 6 stops an increase in the distance between the pair of extending portions 33 to prevent the arc-shaped fitting portion 32 from disengaging from the tubular outer circumferential surface 401 of the second conductor 4. The retaining member 6 of the present embodiment is constituted by a clip that spans the pair of extending portions 33. Also, the clip is formed in the shape of a square ring that holds the pair of extending portions 33 from the outer circumferential side, and stops an increase in the distance between the pair of extending portions 33.

As shown in FIGS. 5 and 6, the pair of extending portions 33 of the present embodiment are formed in a divided manner at a plurality of positions, in the axial direction L, of the arc-shaped fitting portion 32. A recess portion 331 is formed between the divided extending portions 33 aligned in the axial direction L, the recess portion 331 being formed by reducing the length, in the circumferential direction C, of the arc-shaped fitting portion 32. The recess portion 331 is used as a space in which the retaining member 6 is disposed (latched). The retaining members 6 respectively span two pairs of extending portions 33 arranged in the axial direction L.

According to the present embodiment, as a result of the retaining members 6 spanning the respective pairs of extending portions 33, the arc-shaped fitting portion 32 is prevented more reliably from disengaging from the second conductor 4. Accordingly, it is possible to prevent the connection terminal 3 from disengaging from the second conductor 4 more reliably.

Other configurations, functions, and effects of the connection terminal 3 and the terminal connection body 1 of the present embodiment are the same as those of Embodiment 1. Also, in the present embodiment, the constituent components denoted by the same reference signs as the reference signs of Embodiment 1 are the same as those of Embodiment 1.

The reinforcement spring 5 of the present embodiment is provided only on the outer circumferential surface 323 of the arc-shaped fitting portion 32. Instead of this configuration, the reinforcement spring 5 may also be provided that extends continuously from the outer circumferential surface 323 of the arc-shaped fitting portion 32 to the inner circumferential surface of the pair of extending portions 33.

Also, according to the present embodiment, both the reinforcement spring 5 and the retaining member 6 are provided on the arc-shaped fitting portion 32 of the connection terminal 3. On the other hand, only one of the reinforcement spring 5 and the retaining member 6 may also be provided on the arc-shaped fitting portion 32.

The present disclosure is not limited only to the embodiments, and other different embodiments may be configured without departing from the concept thereof. Also, the present disclosure encompasses various changes, modifications, and the like within a range equivalent thereto.

The invention claimed is:

1. A connection terminal for connecting a first conductor and a second conductor, the connection terminal comprising:

a connection configured to be connected to the first conductor;

an arc-shaped fitting that extends from the connection, and is configured to be fitted to, while being in surface contact with, a tubular outer circumferential surface of the second conductor over a half of the circumference thereof, with application of restoring force after elastic deformation;

a pair of extensions that extend from two ends, in a circumferential direction, of the arc-shaped fitting, and are curved to a side opposite to a side to which the arc-shaped fitting is curved; and a reinforcement spring that has the shape of a plate curved in an arc shape along an outer circumferential surface of the arc-shaped fitting, is fitted to, while being in surface contact with, the outer circumferential surface of the arc-shaped fitting over a half of the circumference thereof, and applies restoring force after elastic deformation to the outer circumferential surface of the arc-shaped fitting.

2. The connection terminal according to claim 1, wherein the reinforcement spring is made of a metal material whose specific resistance and spring constant are larger than those of a metal material of which the arc-shaped fitting is made, and the reinforcement spring has a thickness that is less than that of the arc-shaped fitting.

3. The connection terminal according to claim 1, wherein a retainer is provided between the pair extensions, the retainer being configured to stop an increase in a distance between the pair of extensions and prevent the arc-shaped fitting from disengaging from the tubular outer circumferential surface of the second conductor, and the retainer is formed by a clip that spans the pair of extensions.

4. The connection terminal according to claim 1, wherein a plurality of projections are formed in the vicinity of a central portion, in the circumferential direction, of the reinforcement spring, the plurality of projections extending in the circumferential direction.

5. A terminal connection body comprising:

a first conductor having a connection terminal; and a second conductor connected to the connection terminal, wherein the connection terminal includes:

a connection connected to the first conductor;

an arc-shaped fitting that extends from the connection, and is fitted to, while being in surface contact with, a tubular outer circumferential surface of the second conductor over a half of the circumference thereof, with application of restoring force after elastic deformation;

a pair of extensions that extend from two ends, in a circumferential direction, of the arc-shaped fitting, and are curved to a side opposite to a side to which the arc-shaped fitting is curved; and a reinforcement spring that has the shape of a plate curved in an arc shape along an outer circumferential surface of the arc-shaped fitting, is fitted to, while being in surface contact with, the outer circumferential surface of the arc-shaped fitting over a half of the circumference thereof, and applies restoring force after elastic deformation to the outer circumferential surface of the arc-shaped fitting, and the second conductor includes, at a leading end of the second conductor, an increased diameter portion that prevents the arc-shaped fitting from being removed from the tubular outer circumferential surface in an axial direction.

* * * * *